US007708117B2

(12) United States Patent
van der Heiden

(10) Patent No.: US 7,708,117 B2
(45) Date of Patent: May 4, 2010

(54) STAIRLIFT

(75) Inventor: Arnoldus Theodorus van der Heiden, Bergschenhoek (NL)

(73) Assignee: Thyssenkrupp Accessibility B.V., Krimpen aan den IJssel (NL)

( * ) Notice: Subject to any disclaimer, the term of this patent is extended or adjusted under 35 U.S.C. 154(b) by 110 days.

(21) Appl. No.: 10/590,660

(22) PCT Filed: Feb. 28, 2005

(86) PCT No.: PCT/NL2005/000143

§ 371 (c)(1),
(2), (4) Date: Jun. 18, 2007

(87) PCT Pub. No.: WO2005/087644

PCT Pub. Date: Sep. 22, 2005

(65) Prior Publication Data

US 2008/0035430 A1 Feb. 14, 2008

(30) Foreign Application Priority Data

Feb. 26, 2004 (NL) ..... 1025571

(51) Int. Cl.
*B66B 9/08* (2006.01)

(52) U.S. Cl. ..... 187/201

(58) Field of Classification Search ..... 187/200–202; 296/65.06, 65.07

See application file for complete search history.

(56) References Cited

U.S. PATENT DOCUMENTS 2,856,027 A * 10/1958 Schryver ..... 187/201
4,246,848 A * 1/1981 Schneider ..... 104/173.2
4,815,785 A * 3/1989 Goodall et al. ..... 296/65.13
4,913,264 A * 4/1990 Voves et al. ..... 187/201
5,533,594 A * 7/1996 Tremblay et al. ..... 187/201
5,992,935 A * 11/1999 Duijnstee ..... 297/344.21
6,712,192 B1 * 3/2004 Hester et al. ..... 198/321
7,225,899 B2 * 6/2007 Molnar et al. ..... 187/201
2004/0104078 A1 * 6/2004 Szentistvany et al. ..... 187/201
2007/0056803 A1 * 3/2007 Szentistvany et al. ..... 187/201

FOREIGN PATENT DOCUMENTS

GB 2368574 A * 5/2002
JP 05116865 A * 5/1993
WO WO 2004000712 A1 * 12/2003

* cited by examiner

*Primary Examiner*—Thomas J. Brahan
(74) *Attorney, Agent, or Firm*—Jacobson Holman PLLC

(57) ABSTRACT

The platform of a stairlift is moved along a rail in a stairwell. During the movement, the platform is automatically rotated relative to the rail about a vertical shaft, at angles depending on a position of the platform along the rail. The stairway contains, for instance, a virtually straight part and a bend, wherein the platform is rotated, at positions in the bend, at an orientation or orientations which make a smaller angle with a part of the rail going downstairs than an orientation of the platform in the straight part. In a stairwell with a wider part and a narrower part, wherein the stairwell is insufficiently wide to let the platform rotate through, at a position preceding the entering of the narrower part, the platform is rotated at an angle from which the platform can be rotated to a position for getting on and off in the narrower part without obstruction from walls of the stairwell.

11 Claims, 2 Drawing Sheets

STAIRLIFT

This is a nationalization of PCT/NL05/000143 filed Feb. 28, 2005 and published in English.

FIELD OF THE INVENTION

The invention relates to a stairlift. A stairlift is a solution for the transport of sitting persons or things in places where there is no room for a normal lift shaft.

BACKGROUND OF THE INVENTION

An example of a stairlift is described in U.S. Pat. No. 5,533,594. Known stairlifts comprise a rail, which is mounted above the stairway on the inner or outer wall of the stairwell, a platform (for instance a chair, or a floor for, for instance, a wheelchair) and a drive mechanism for moving the platform along the rail and thereby along the stairway. It is further known to provide a second drive mechanism to keep the platform horizontal. This second drive mechanism rotates the platform about a horizontal shaft relative to the rail, depending on the gradient of the rail at that location.

Above-mentioned U.S. Pat. No. 5,533,594 describes how, during getting on and getting off, use is also made of the rotation of the platform about a vertical shaft, which is known in this field by the term "swiveling". In this manner, the transported person is turned to the step at the top and bottom of the stairway. For this, two positions are needed (for the top and the bottom of the stairway, respectively) which are mutually rotated relative to the rail through 180 degrees. En route, the platform is fixed in a transport position, which is, for instance, midway between the two positions for getting off, with the transported person facing the wall.

The patent specification describes how, for swiveling, use can be made of a combined rotation and translation movement to prevent the platform on the stairlift from hitting the wall during the swiveling from the positions for getting on and getting off to the transport position.

The space available in a stairwell is a factor which determines whether a stairlift can be placed. It will be clear that placement is not possible if the platform does not fit between the walls of the stairlift or if there is too little headroom left under the ceiling of the stairwell. In particular, this is often the case in stairways with bends. Also, swiveling for getting on and off is not possible if the stairwell does not provide sufficient space for this.

SUMMARY OF THE INVENTION

It is one of the objects of the invention to provide a stairlift which can be placed in stairwells with less space than existing stairlifts with a platform of the same size and/or height.

It is one of the objects of the invention to provide a stairlift which can be placed in stairwells with bends and makes efficient use of the available headroom.

The invention provides a stairlift and a method for moving the stairlift. According to the invention, the stairlift contains a drive for carrying out swivel rotations during the movement of the stairlift along the rail, in order to prevent collisions with the walls of the stairwell and/or steps of the stairway. At locations along the rail where such collisions would occur without rotation, the platform is rotated away from the respective wall or step relative to the rail. In this manner, in bends, the platform can be kept clear of the steps without a greatly raised mounting of the rail being necessary. As a result, more headroom is left. With the aid of a location-dependent rotation, the platform can also be moved along the rail in a more limited space, so that the stairlift can be used in narrower stairwells.

BRIEF DESCRIPTION OF THE DRAWINGS

These and other objects and advantageous aspects of the invention will be described on the basis of examples with reference to the following drawings, in which.

DETAILED DESCRIPTION OF THE PREFERRED EMBODIMENTS

Figure 1:
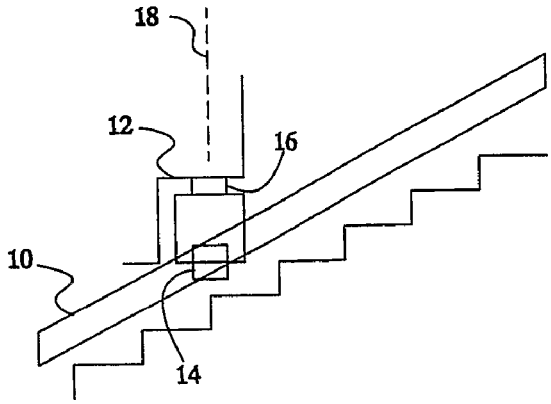
FIG. 1 shows a stairlift.

FIG. 1 shows a stairlift, with a rail 10, and a platform 12 and two motors 14, 16 thereon. In the Figure, platform 12 is a chair. It will be clear that, in the framework of the invention, the term "platform" is to be understood in a general sense as any structure with a supporting surface, without necessarily being limited to a surface.

A first motor 14 serves to drive the movement of the platform 12 along rail 10. First motor 14 is, for instance, provided with a gear wheel (not shown) in a manner known per se and rail 10 is provided with a row of teeth (not shown) with which the gear wheel engages, so that, upon rotation of first motor 14, platform 12 moves up or down along rail 10. In this manner, platform 12 is always supported by essentially one point on rail 10, so that, without further measures, the orientation of platform 12 would follow the orientation of the rail at the location of the supporting point.

A second motor 16 serves to rotate platform 12 relative to rail 10 about a vertical shaft 18. Platform 12 is arranged rotationally about vertical shaft 18, for instance on a bearing (not shown) and second motor 16 drives a rotational movement about this shaft. Any form of transmission can be used, for instance by providing the shaft of second motor 16 directly onto a rotary shaft of platform 12, or by means of a gear wheel transmission, etc.

Further, the stairlift is preferably provided with a third motor, which serves to keep the sitting surface of platform 12 horizontal. This third motor is not shown in FIG. 1, so that the description is not unnecessarily complicated. The third motor serves to rotate the platform about a horizontal shaft perpendicular to a plane through rail 10 and the vertical, i.e. perpendicular to the wall on which rail 10 has been mounted. The rotation about this shaft compensates for the effect of changes in the gradient of rail 10. Instead of a third motor, a mechanical transmission may also be used for this purpose, so that this rotation is driven by the movement along rail 10.

Figure 2:
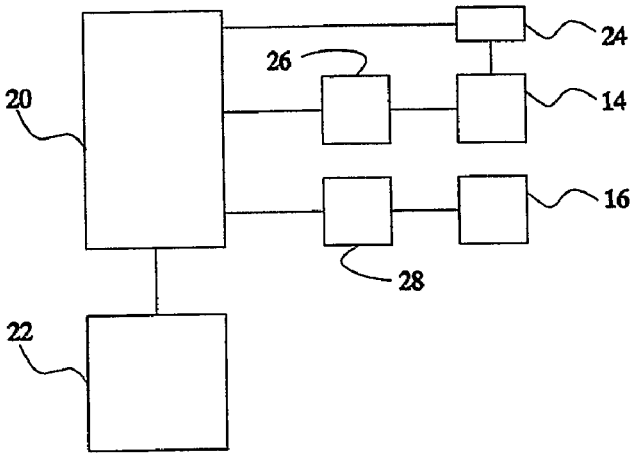
FIG. 2 shows a control system.

FIG. 2 shows a control system for the stairlift. The control system comprises a microcontroller 20, a memory 22, a rotation sensor 24 and a first and second motor power supply 26, 28. Microcontroller 20 is coupled to memory 22, rotation sensor 24 and first and second motor power supply 26, 28. First and second motor power supply 26, 28 drive first motor 14 and second motor 16.

Memory 22 contains information representing a desired angle of rotation of platform 12 about vertical shaft 18. Any form of representation can be used, such as a look-up table in which desired angle values are stored for a number of positions along the rail (for instance represented by the number of rotations of first motor 14 before this position is reached), or coefficients of a polynomial representing the desired angle values as a function of the position along the rail (number of rotations of first motor 14).

Microcontroller 20 has been programmed to activate first motor 14 when platform 12 is to be moved along rail 10 upstairs or downstairs. Sensor 24 records the number of rotations of first motor 14. The position of platform 12 along rail 10 follows from this information. Microcontroller 20 reads this sensor information and then determines a desired angle for platform 12 on the basis of this sensor information and the information in memory 22.

Any suitable form of determination of the angle on the basis of sensor information and information from memory 22 can be used. This, for instance, takes place by using the sensor information as an address in memory 22 in order to thus read out the desired angle, or by interpolation between angle values for approximate sensor values for which angle values are stored in the memory, or by calculation on the basis of stored coefficients (read-out information can be determined for different positions of platform 12; in this case, it is not necessary to read out information from memory 22 for each sensor value).

Microcontroller 20 then controls second motor power supply 28 if necessary to make second motor 16 make platform 12 rotate to the angle desired for the position reached along rail 10.

The information in memory 22 is chosen such that collisions are prevented between platform 12 and walls of the stairwell in which the stairlift is arranged, and/or steps of the stairway. Also, if necessary, the information is chosen such that sufficient headroom is left in the stairwell during movement along rail 10. It is further possible to change the angle en route such that it allows the required rotation to the position for getting on and off at the end of the stairway. This will be illustrated with reference to a number of Figures.

Figure 3:
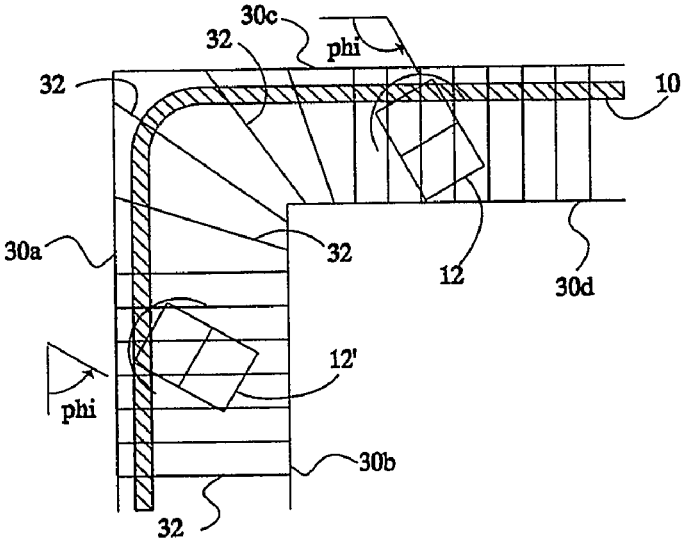
FIG. 3 shows a top plan view of a stairwell.

FIG. 3 shows a top plan view of a stairwell, with a stairlift therein. The stairwell has walls 30*a-d*, and steps 32. Platform 12 is drawn at two positions along rail 10, where it makes an angle phi relative to rail 10. The stairway makes an angle of 90 degrees. In the bend, steps 32 narrow in the direction of the center of the bend. When platform 12 is moved along rail 10, the platform needs to be prevented from hitting the walls of the stairwell, or the steps. Whether there is a risk of this happening depends on inter alia the width of the stairwell and the height of rail 10 above the steps.

Even when rail 10 is mounted so high above the steps that there is no risk of collision with steps 32 on the straight parts of the stairway, there may, for instance, be a local risk of collision in the bend due to the narrowing of steps 32. In the prior art, in case of a stairway with a bend, it was therefore necessary to mount rail 10, at least at the location of the bend, higher above steps 32 than necessary in the straight parts. This prevents the risk of collision with steps 32. However, this reduces the headroom above the platform. This may in turn cause problems in stairwells with limited space.

According to the invention, the risk of collisions with steps 32 in the bend is avoided by rotating the platform locally in the bend relative to rail 10 about vertical shaft 18, in order to thus avoid steps 32. This makes it possible to mount rail 10 less high relative to the steps 32, so that more headroom is left.

Figure 4:
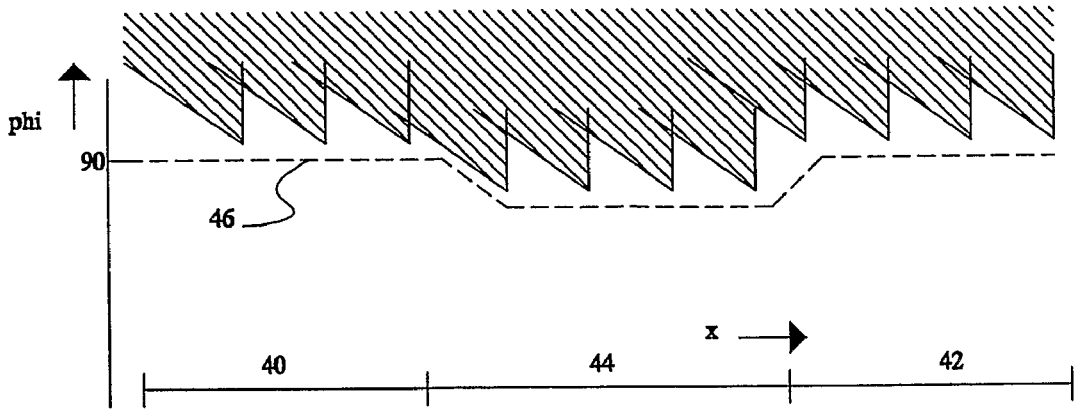
FIGS. 4, 4*a* and 5 show x=phi diagrams.

FIG. 4 illustrates a simplified example of angles phi of platform 12 relative to rail 10 at which collision with steps 32 occurs as a function of position x along rail 10. The ranges designated by 40 and 42 relate to positions in the straight parts of the stairway. The range designated by 44 relates to positions in the bend. The Figure is drawn for a given mounting height of rail 10.

The Figure shows a sawtooth pattern, in which each sawtooth corresponds with a step 32. When approaching a step 32 (increasing x), the maximum attainable angle phi becomes increasingly smaller, to a point of clearance where the lower part of the platform 12 exceeds the step 32. Thus, a no-go area (hatched) is created of combinations of positions x and angles phi which are not possible. When the rail is mounted higher above the steps, the shape of the sawteeth remains the same, but the point of clearance is at a smaller "x", so that a larger angular range remains allowed. In the bend of the stairway, the no-go area is already reached for smaller angles because the steps converge there, i.e. do not make a right angle with the rail.

The Figure makes it clear that, at this height, in the straight parts of the stairway, at the given mounting height, platform 12 can be arranged at an angle of 90 degrees relative to rail 10 without there being a risk of collision with the steps. In the range 44 of the bend, this is not possible, because steps 32 recede inwards, viewed from a position facing away from rail 10.

Figure 4A:
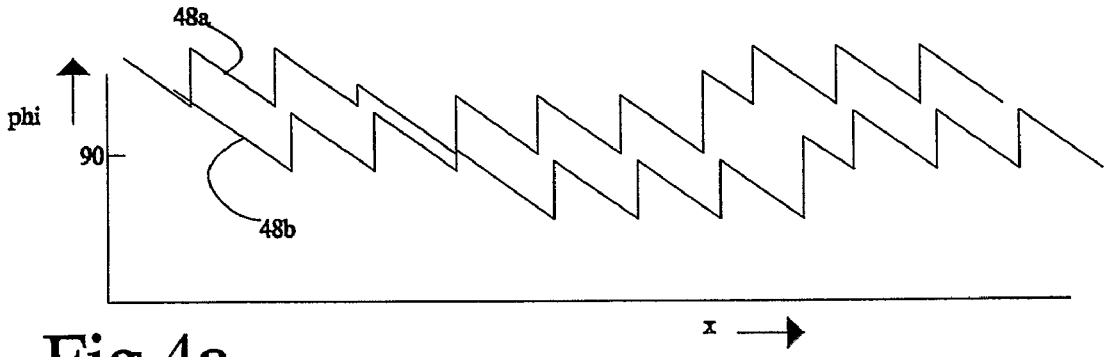

Nevertheless, it is still possible to pass the bend if the angles follow a path 46 indicated in dotted lines, in which, in the bend, the angle of platform 12 is rotated relative to rail 10. In the straight parts, a transported person can thus be transported in the position experienced as being the most safe, with the back to the wall, i.e. at an angle phi of 90 degrees relative to rail 10, while the angle phi is temporarily changed in the bend:

FIG. 4*a* shows a number of different limits 48*a,b,* corresponding to those of FIG. 4, but for different mounting heights of rail 10. With a higher mounting, the clearance for each step 32 already occurs for smaller x, so that the limit reaches less low phi values. A second mounting height has been chosen so as to be so high that the corresponding limit 48*a* allows the platform to permanently make an angle of 90 degrees with rail 10. With a lower mounting, the clearance for each step 32 only occurs for greater x, so that the limit reaches lower phi values. The second limit 48*b* corresponds with a lower mounting height where smaller angles are allowed. It will be clear that a lower mounting height is needed due to the use of rotation.

The chosen path 46 defines a functional relation between position x and angle phi for a given stairway and arrangement of the stairlift. This functional relation is programmed in memory 22 for use during the movement of the stairlift.

It needs to be realized that FIGS. 4 and 4*a* are only given to illustrate the invention. In practice, the stairlift can be installed without using such Figures, for instance by measuring whether an installation with a given height of the rail and rotation of the platform is possible. If use is made of such a Figure, or corresponding information, then it can be determined by measuring maximum (or minimum) allowed angles at different positions and clearance heights, or on the basis of calculations based on measured dimensions of the stairwell.

Local rotation of platform 12 may also be used for other applications.

In a first example, local rotation is used to "switch", so that platform 12 can be rotated both at the top and the bottom of the stairway to a position for getting on and off in the case that a stairwell is too narrow to rotate platform 12 through an angle phi of 90 degrees in the straight parts of the stairwell.

Figure 5:
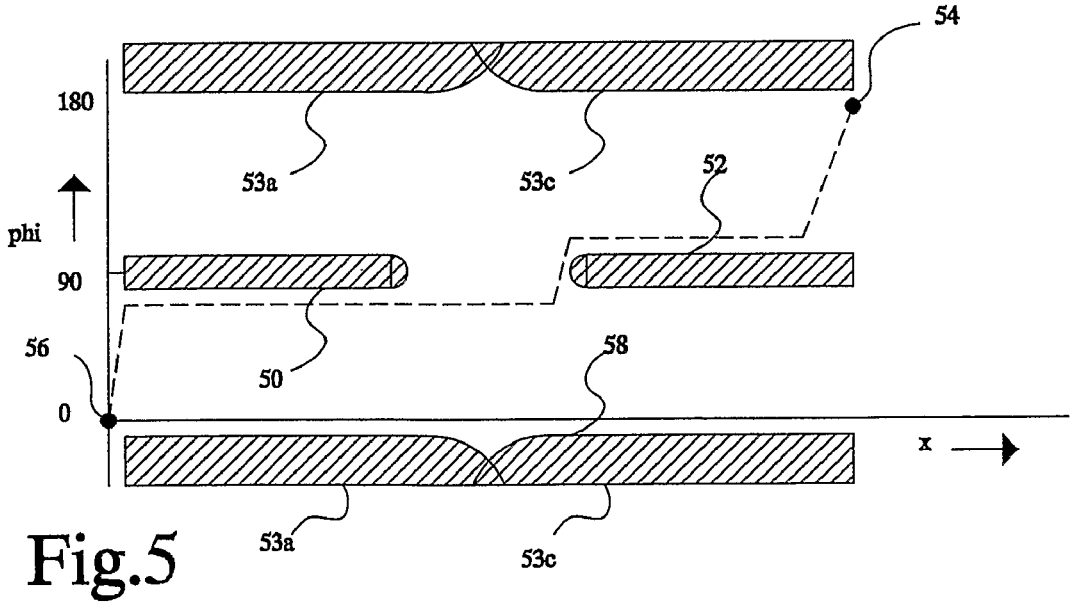

FIG. 5 shows a simplified example of angles phi of platform 12 relative to rail 10 at which collision with the walls of the stairwell occurs as a function of position x along rail 10. This example relates to a narrow stairwell, in which platform 12 only fits in the straight parts at an angle. Platform 12 does not fit there at an angle phi of 90 degrees. This results in no-go areas 50, 52 which form a partition between different angles between which platform 12 cannot rotate in the straight parts. In the bends, these no-go areas are absent. Further, there are no-go areas 53*a,c* due to the outer walls 30*a,c* of the stairwell. At the top and bottom of the stairway, positions 54, 56 at angles phi of 0 and 180 degrees are necessary to get on and off.

According to the invention, a path 58 is followed where, by rotation relative to rail 10, a transition is made which makes it possible to make a rotation towards the position for getting on and off both at the top and the bottom of the stairway.

It will be clear that, with this rotation, the steps also need to be taken into account. For this purpose, the limits due to the steps should also be drawn in FIG. 5. As long as these limits allow a path 58 between the desired positions for getting on and off, the stairlift can be operated.

It is even not precluded that it is a path which locally travels back in the x-direction to avoid obstacles. This corresponds with a switching movement of the platform (analogous to reverse parking), where the platform first moves forwards along rail 10, then rotates about vertical shaft 18, then moves back a bit along rail 10, rotates again about vertical shaft 18, and then moves forwards again along rail 10. For this purpose, the microcontroller 20 is to be programmed accordingly in order to temporarily operate first motor 14 in reverse direction and have second motor 16 carry out the corresponding rotations after reaching a particular position along rail 10. If no path is possible at all, then it is necessary to mount rail 10 higher, for instance.

Other examples of uses of local rotations of platform 12 relative to rail 10 are, for instance, local rotations to prevent collisions with the walls at the location where rail 10 makes a bend. This can, for instance, make it possible to mount rail 10, or platform 12, closer to the wall of the stairwell, or to make sharper bends than is possible without local rotations. In all cases, it is possible, for a particular arrangement, for any possible obstacle (such as steps and walls) to draw the limits to where rotation is possible in an x-phi diagram. On the basis of such a diagram, in a simple manner, a path can be chosen which respects these limits.

It will be clear that there is some freedom in the choice of the paths through the x-phi diagram. The paths are preferably chosen such that phi approximates 90 degrees as closely as possible (which corresponds with an angle where the transported person is facing away from rail 10. This is experienced as being the most safe.)

Although preferably use is made of programmed paths, it is also possible to have microcontroller 20 choose the paths dynamically. For this purpose, the stairlift can be equipped with collision sensors, on the basis of which microcontroller 20 can adjust the angle. If it has been checked in advance that there is a simple path, microcontroller 20 can thus choose that path dynamically. In addition, incidental obstacles can be avoided, or cause interruption of the movement.

Preferably, the vertical shaft coincides with the center of a circle which is essentially formed by an outside of a back and armrests of a chair forming the platform. Thus, the back is no obstruction to rotations.

Although the invention has been described for a particular construction of the swivel mechanism, it will be clear that the invention can also be applied to other mechanisms. For instance, a displaceable vertical rotary shaft can be used about which the platform rotates. Here, for instance a fixed coupling is possible between angle of rotation and shaft displacement. This in itself does not change the principles of the invention. Again, an x-phi diagram can be drawn, with the limits where the combined rotation and displacement lead to collisions of walls or steps. From this diagram, then a path can be chosen, which can serve as a basis for programming memory 22.

In principle, it is even possible to control the shaft displacement, or any other displacement of platform 12, in a manner uncoupled from rotation about the shaft. This creates still more possibilities to prevent collisions. Insight in this can be provided by replacing the x-phi diagram by a higher dimensional diagram (for instance an x-phi-y diagram, where y is the shaft displacement) and choosing a path herein. In this embodiment, the stairlift is, for instance, equipped with an extra motor to control the shaft displacement and microcontroller 20 is programmed to control this extra motor as well according to a programmed relation depending on the position x along rail 10.

Although the rotation of platform 12 about vertical shaft 18 is preferably controlled electronically, it will be clear that mechanical solutions are also possible, with which, depending on the position of platform 12 along rail 10, the required rotations can be generated. For this, similar techniques can be used as for leveling.

Although preferably use is made of a uniform speed of movement of platform 12 along rail 10, with rotations coupled thereto, use can also be made of non-uniform speeds without deviating from the invention. For instance, microcontroller 20 can be programmed to temporarily decelerate the movement along rail 10 if a rotation about vertical shaft 18 is necessary. This may, for instance, reduce the maximum acceleration.

Preferably, microcontroller 20 is also programmed with safety measures in order to move platform 12 back along rail 10, or, if possible, move it at an angle free from collision, upon detection of blocking of the rotation about vertical shaft 18. For instance, in a sufficiently wide stairwell, upon blocking, it can be decided not to rotate platform 12 so as to be perpendicular to rail 10 in the straight parts (so that the transported person is not sitting with the back directly to the wall).

The invention claimed is:

1. A stairlift for mounting along a stairway, said stairlift comprising a rail, a platform movably mounted on the rail, a drive mechanism for moving the platform along the rail along the stairway, the platform being mounted so as to be movable about a vertical shaft relative to the rail, a drive automatically driving an angle of rotation of the platform about the vertical shaft relative to an orientation realized by moving the platform along the rail dependent on a particular position of the platform along the rail at a location significantly spaced between ends of the rail, during movement of the platform along the rail, and a control system for controlling coordinated movement of the platform along an entire length of the rail by the drive mechanism and the drive.

2. The stairlift according to claim 1, wherein the rail comprises a virtually straight part and a bend, and the drive rotates the platform, at positions in the bend, at an orientation or orientations which make a smaller angle with a part of the rail in the bend than an orientation of the platform in the straight part.

3. The stairlift according to claim 2, wherein the rail is mounted in a stairwell, at such a height above the stairway that a bottom side of the platform does not contact the steps of the stairway during the movement along the rail, and the height is less than a height which would be needed for not contacting the steps in the bend if, in the bend, the platform would be kept at an orientation of the platform in the straight part.

4. The stairlift according to claim 1, wherein the rail is mounted in a stairwell with the stairwell having a wide part and a narrow part narrower than said wide part, and the stairwell is insufficiently wide to let the platform rotate completely, and the drive is arranged to rotate the platform, at a position preceding the entering of the narrow part, at an angle from where the platform can be rotated to a position for getting on and off in the narrow part without obstruction from walls in the stairwell.

5. The stairlift according to claim 4, wherein the stairwell includes a bend with parts on both sides, and the stairwell is insufficiently wide to let the platform rotate completely, and the drive is arranged to make the platform rotate between angles from which the platform can be rotated to a position for getting on and off in the respective parts without obstruction from walls of the stairwell.

6. The stairlift according to claim 1, wherein the rail is mounted in a stairwell such that, if the platform stood still at any fixed angle about the vertical shaft during movement along the rail, the platform would hit a step of the stairway or a wall of the stairwell at any point along the rail, and the drive is arranged to change said angle of the platform relative to the rail en route along the rail such that the platform is prevented from hitting steps and/or the wall.

7. The stairlift according to claim 1, wherein the drive is provided with a position sensor for detection of a position of the platform along the rail, memory means includes information about a desired angle setting as a function of the position, and a motor, and the sensor is coupled to the memory means for reading out information about a desired angle setting depending on sensor information, and the memory means is coupled to the motor for controlling the angle depending on the read-out information about the desired angle setting.

8. The stairlift according to claim 1, wherein the drive mechanism to move the platform along the rail along the stairway is coupled to the drive for the angle about the vertical shaft and the drive for the angle about the vertical shaft is arranged to set the angle depending on a progress of the drive mechanism.

9. A method for driving a platform along a rail mounted in a stairwell, said method comprising the step of mounting a platform on the rail, moving the platform along the rail along the stairwell, moving the platform about a vertical shaft relative to the rail, automatically driving a rotation of the platform relative to the rail about the vertical shaft during movement of the platform along the rail, spaced between ends of the rail, at angles depending on a position of the platform along the rail, and controlling coordinated movement of the platform along an entire length of the rail.

10. The method according to claim 9, wherein the rail includes a virtually straight part and a bend, and the platform is rotated, at positions in the bend, at an orientation or orientations which make a smaller angle with a part of the rail going downstairs than an orientation of the platform in the straight part.

11. The method according to claim 9, wherein the rail is mounted in a stairwell with the stairwell having a wide part and a narrow part narrower than said wide part, the stairwell is insufficiently wide to let the platform rotate completely, and the platform is rotated, at a position preceding the entering of the narrow part, at an angle from where the platform can be rotated to a position for getting on and off in the narrow part without obstruction from walls in the stairwell.

* * * * *